United States Patent [19]

Topping et al.

[11] 4,455,673

[45] Jun. 19, 1984

[54] STEREO INDICATING CIRCUIT

[75] Inventors: Douglas R. P. Topping, Waltham Abbey; David W. Walton, Otley; Leslie R. Sage, Ilford, all of England

[73] Assignee: Thorn Emi Ferguson Limited, London, England

[21] Appl. No.: 401,222

[22] Filed: Jul. 23, 1982

[30] Foreign Application Priority Data

Jul. 25, 1981 [GB] United Kingdom ..... 8123008

[51] Int. Cl.[3] ..... H04H 5/00; H04S 7/00

[52] U.S. Cl. ..... 381/12

[58] Field of Search ..... 179/1 GN; 358/198; 324/78 Q, 83; 381/12

[56] References Cited

U.S. PATENT DOCUMENTS 4,236,041 11/1980 Thomas ..... 381/12

FOREIGN PATENT DOCUMENTS 2223432 12/1973 Fed. Rep. of Germany ..... 381/12
2338482 2/1975 Fed. Rep. of Germany ... 179/1 GN
2439505 10/1978 France .
156483 12/1980 Japan ..... 358/198

OTHER PUBLICATIONS

Funk-Technik, vol. 30, No. 6, 1975, pp. 129-130, Munchen, DE J. Rathlev "Neuartige Stereo-Anzeige" with translation.

Elektor, vol. 2, Jul./Aug. 1976, p. 763, Canterbury, G. B., Paragraph 96.

*Primary Examiner*—R. J. Hickey

*Attorney, Agent, or Firm*—Fleit, Jacobson, Cohn & Price

[57] ABSTRACT

In a circuit for indicating reception of stereo signals (for use in e.g. a radio tuner or television) audio signals prevailing in the left (L) and right (R) output channels are applied to respective limiting circuit and the output signals derived are fed to OR gate. When a monoaural signal is detected, the signals in the two output channels will be in coincidence and so the output from the exclusive OR gate remains low. When stereo signals are detected, however, a finite phase difference exists between the two signals and the output for the OR gate is correspondingly high. A Schmitt trigger drives an LED display whenever the output from the OR gate exceeds a preset threshold level to provide an indication that a stereo signal is being reproduced. A capacitor/resistor circuit imposes a time delay on level changes at gate so that the LED display remains illuminated, even during momentary interruptions of the audio signal.

8 Claims, 3 Drawing Figures

Figure 3:
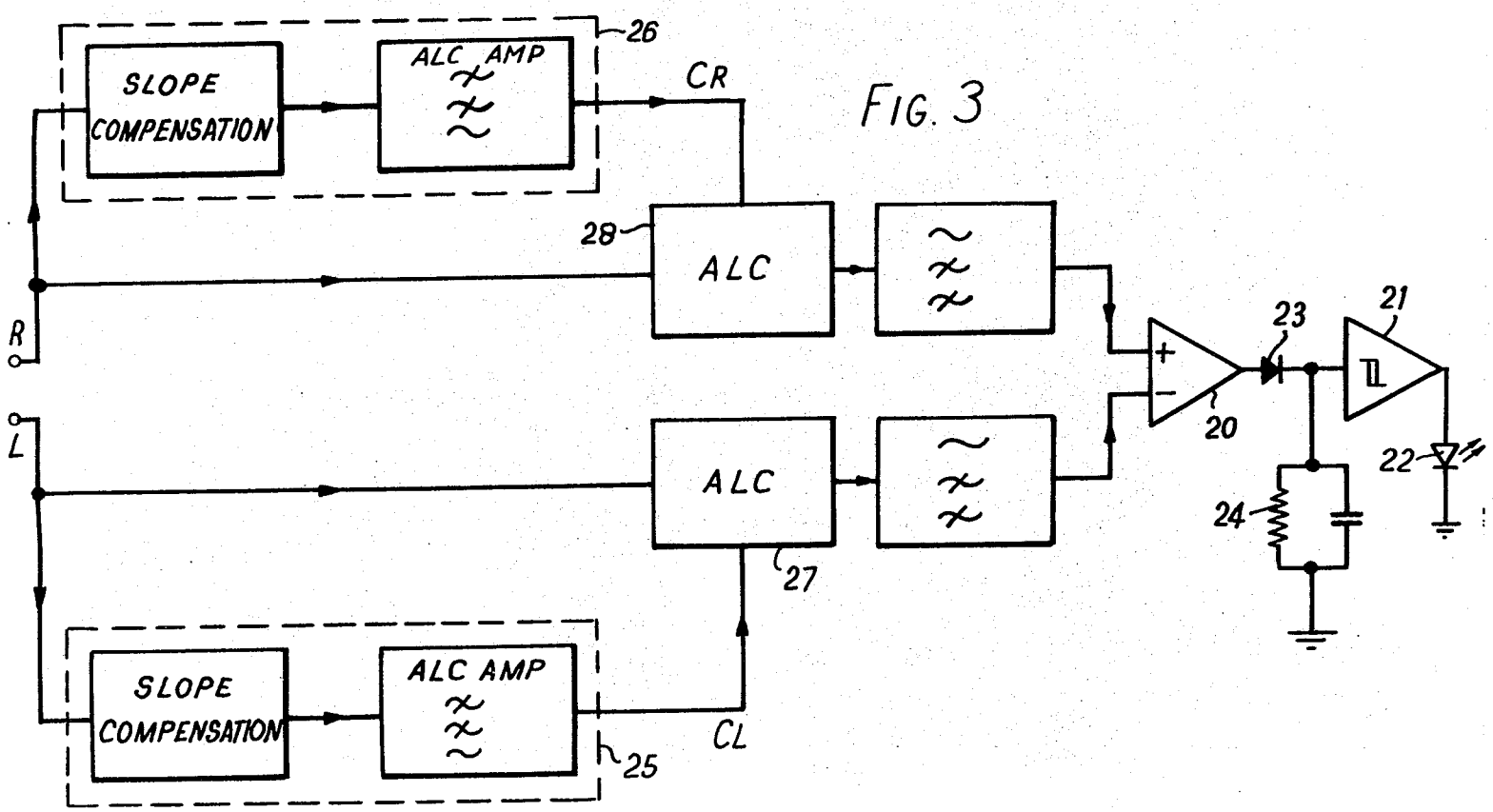

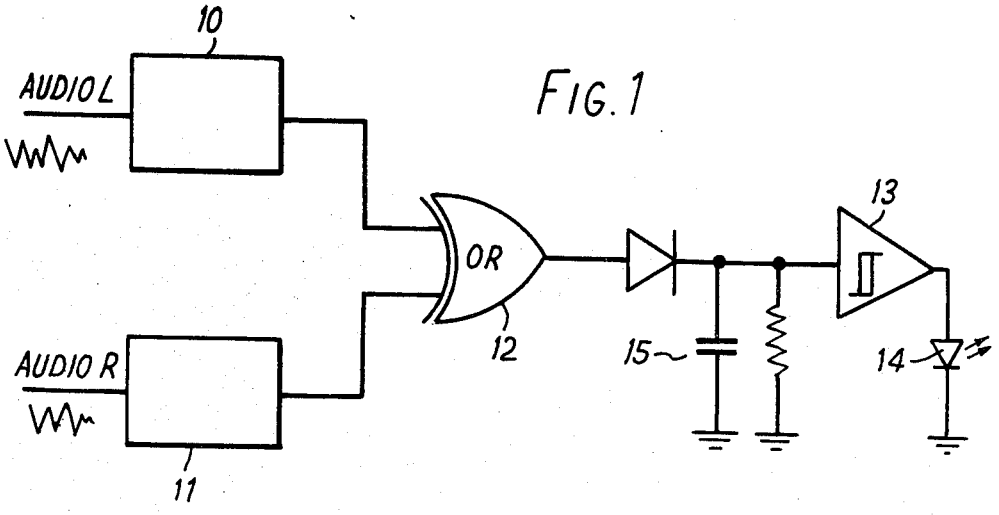
FIG. 1
FIG. 2
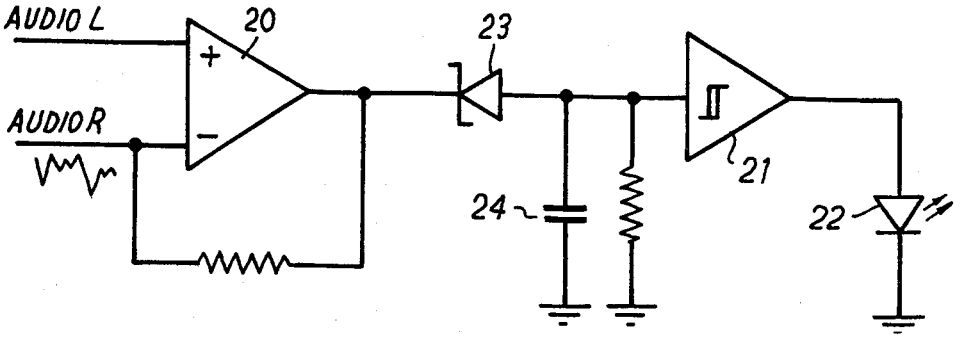

STEREO INDICATING CIRCUIT

This invention relates to reproduction of audio signals and especially to reproduction of audio stereo signals.

It is known that VHF radio signals, for example, include a characteristic 38 KHz subcarrier whenever stereo signals are transmitted, and conventionally this subcarrier is used by a reproduction apparatus (a stereo receiver, for example) to indicate that stereo signals are in fact being reproduced. Typically, this is achieved by energising a suitable indicator light. In the case of certain audio signals, particularly signals used for television sound reproduction or signals derived from video disc or video tape, the 38 KHz subcarrier may be absent, yet it may still be desirable to provide an indication of stereo reproduction.

It is an object of the present invention to provide an indication of stereo reproduction even in the absence of the 38 KHz subcarrier.

According to the invention there is provided a circuit for use in association with an audio receiving apparatus to indicate reproduction of a stereo signal, said circuit comprising first circuit means, responsive to a difference in phase between audio signals prevailing in different output channels of said apparatus to generate a first signal, and further means for utilising said first signal to generate an indication of stereo reproduction.

In order that the invention may be more readily understood and carried into effect specific examples thereof are now described, by way of example only, by reference to the accompanying drawings of which, FIG. 1 illustrates a circuit used for detecting lack of coincidence between audio signals in different output channels of a stereo input, FIG. 2 illustrates a circuit used to detect a difference in amplitude between simultaneously received signals in different channels and, FIG. 3 illustrates an improved form of the circuit shown in FIG. 2.

In accordance with the present invention, a stereo audio signal is sensed by detecting a phase difference between signals received simultaneously in different output channels of a reproducing apparatus—a television receiver, for example.

In one embodiment of the invention, illustrated in FIG. 1, audio signals prevailing in the left and right output channels (designated L and R in the drawing) are applied to respective limiting circuits 10 and 11 and the output signals derived therefrom are fed to respective input terminals of an exclusive OR gate 12. When a monoaural signal is detected, the signals prevailing in the two output channels will be in coincidence and so the output from the exclusive OR gate remains low. When stereo signals are detected, however, a finite phase difference exists between the two signals and the output for the OR gate is correspondingly high. A Schmitt trigger 13 is provided to drive an LED display 14 whenever the output from the OR gate exceeds a preset threshold level, and in this way provides an indication that a stereo signal is being reproduced. To ensure that the LED display remains illuminated, even during momentary interruptions in the incoming stereo signal, as occurs in speech, for example, a capacitor/resistor circuit 15 is used to impose a time delay (of 5 to 10 secs, say) on level changes occurring at the output of gate 12. In this way an essentially continuous indication of stereo reproduction is achieved.

In an alternative embodiment of the present invention, illustrated in FIG. 2, the two audio signals occurring in the left and right output channels are differenced using an operational amplifier 20 and an output signal therefrom, indicative of a phase difference between the two audio signals is again used to actuate a Schmitt trigger 21 which drives an LED display 22 when a preset threshold level is exceeded. A Zener diode 23 is provided to block signals of excessively high amplitude—noise spikes, for example, and a delay circuit 24, of the kind described earlier, in relation to the first alternative embodiment, is again used to provide for an essentially continuous illumination while the stereo signal is being reproduced.

The amplitude of the stereo signal, when averaged over a time interval, is generally rather low compared with the amplitude of a monoaural component. Since the differential amplifier 20 has a high gain it is conceivable that a small amplitude difference between the signals prevailing in the two channels, as may result from a slightly worn or misaligned magnetic tape, for example, may be incorrectly interpreted as a stereo signal. It is desirable, therefore, that the amplitude level of the signals in the two channels should be maintained within about 1 dB of one another.

As shown in FIG. 3, this can be achieved using respective dynamic slope cancelling A.L.C. circuits 25, 26. Since these circuits tend to attenuate any stereo signal which may be present they are arranged to monitor only relatively low frequencies (less than about 300 Hz) and generate respective control signals $C_L$, $C_R$ which are fed to further A.L.C. circuits 27, 28 which then apply appropriate gain corrections to the entire audio signal. In this way the more important high frequency stereo signals remain attenuated by the gain correction procedure.

It will be appreciated that the present invention provides for an indication of stereo reproduction even in the absence of a 38 KHz subcarrier. It will also be appreciated that the invention is not limited to the above-described embodiments, other embodiments encompassed by the invention, will also be envisaged by persons skilled in the art.

We claim:

1. A circuit for use in association with an audio reproducing apparatus to indicate reproduction of a stereo signal, said circuit having:

first circuit means responsive to a difference in phase, but substantially unresponsive to a difference in amplitude, between audio signals prevailing in different output channels of said apparatus in order to generate a first signal;

means to provide automatic level control amplification of audio signals prevailing in different output channels of said apparatus, said amplification means being included in the said first circuit means; and further circuit means for utilizing said first signal to generate an indication of stereo reproduction.

2. A circuit according to claim 1, further comprising means to produce control signals for a gain correction on the audio signal in each channel, said control signals for gain correction being dependent on monoaural information in the audio signals, said amplification means including said control signal production means.

3. A circuit according to claim 1, further comprising an automatic level control circuit in each channel to apply a gain correction on the audio signal in that channel in response to the output from another automatic level control circuit, said amplification means including the automatic level control circuits.

4. A circuit according to claim 1, further comprising means for differencing signals prevailing in said different output channels of the apparatus, the first circuit means including said differencing means.

5. A circuit according to claim 4, further comprising an operational amplifier in the differencing means.

6. A circuit according to claim 1, further including means for delaying changes in said first signal.

7. A circuit according to claim 6, further comprising a resistor and capacitor circuit in said delay means.

8. A circuit according to claim 1, further comprising an LED display included within said further circuit means.

* * * * *